US008430051B1

(12) United States Patent
Allison

(10) Patent No.: US 8,430,051 B1
(45) Date of Patent: Apr. 30, 2013

(54) ELECTRONICS PEDESTAL FOR BOATS

(76) Inventor: Darris E. Allison, Louisville, TN (US)

( * ) Notice: Subject to any disclaimer, the term of this patent is extended or adjusted under 35 U.S.C. 154(b) by 202 days.

(21) Appl. No.: 13/044,033

(22) Filed: Mar. 9, 2011

Related U.S. Application Data

(60) Provisional application No. 61/423,314, filed on Dec. 15, 2010.

(51) Int. Cl.
*B63B 17/00* (2006.01)

(52) U.S. Cl.
USPC ..... 114/364; 114/343

(58) Field of Classification Search ..... 114/343, 114/364, 363; 440/2
See application file for complete search history.

(56) References Cited

U.S. PATENT DOCUMENTS 4,856,452 A * 8/1989 Pingel et al. ..... 114/364
5,304,993 A * 4/1994 Handsaker ..... 114/343
5,919,067 A * 7/1999 Smith ..... 440/2
6,155,195 A * 12/2000 Nirenberg ..... 114/343

OTHER PUBLICATIONS

Jim Barron, "Sea of Change", p. 32 of Bass & Walleye Boats, Apr. 2004 XB21 Pro Model BasSport Pro Allison Ultra Performance Boats (1 page).
XB21 Pro Model—Brochure, 2004.

* cited by examiner

*Primary Examiner* — Lars A Olson

(57) ABSTRACT

A telescopic pedestal for electronics, such as fish-finders, that advantageously elevates the fish-finder to a convenient height above the deck level and gives the fisherman the ability to view and operate the device while fishing in a standing position, yet lower it so as conveniently position the fish-finder to be out of the way for travel or when not in use.

8 Claims, 17 Drawing Sheets

ELECTRONICS PEDESTAL FOR BOATS

CROSS-REFERENCE TO RELATED APPLICATION

This application claims priority to U.S. Provisional Application Ser. No. 61/423,314 filed Dec. 15, 2010, and entitled ELECTRONICS PEDESTAL FOR BOATS, incorporated by reference herein in its entirety.

FIELD

The present disclosure relates to an electronics pedestal for boats. More particularly, the disclosure relates to a telescopic pedestal system that enables selective positioning of boat electronics relative to the deck, with further enhancements and aesthetics provided by a well for locating the pedestal system.

BACKGROUND AND SUMMARY

Most modern-day fishing boats are equipped with an electronic fish-finder device that is mounted directly on the casting deck at the bow of the boat. As the name implies, the "fish-finder's" main purpose is to help the fisherman to locate fish in order to maximize his catch. Electronic fish-finder units come in a variety of sizes and have a multitude of push-buttons for operating their many functions. The fish-finder unit is usually mounted either on a gimbal bracket directly to the surface of the deck platform; or it is flush-mounted into a well or panel built in the forward section of the deck. An example of a fish-finder flush-conventionally mounted into a well built in the forward section of the deck is shown in FIG. 1.

In either case, a fish-finder mounted at or near deck level is difficult to read and impossible to operate while fishing from a standing position. It is therefore necessary for the fisherman to kneel or squat each and every time he operates the fish-finder, since the vertical location of the fish-finder is fixed. Repetitive kneeling or squatting is not only very inconvenient; it consumes valuable fishing time, and could be somewhat difficult for some people to endure over a period of time.

The disclosure advantageously provides a telescopic pedestal for electronics, such as fish-finders, that advantageously selectively elevates the fish-finder to a convenient height above the deck level and gives the fisherman the ability to view and operate the device while fishing in the standing position, yet lower it so as conveniently position the fish-finder to be out of the way for travel or when not in use.

In a preferred embodiment, the pedestal includes a base mounted to the deck adjacent an aperture defined through the deck, a lower mast section slidingly positionable relative to the base and the aperture of the deck, and an upper mast section.

The lower mast section has a larger diameter than the upper mast section so that the upper mast section slides into the lower mast section to form a telescopic mast that may be configured to: (i) a retracted position in which a lower end of the lower mast section is substantially below the deck and the upper mast section is substantially within the lower mast section to position the electronic device substantially proximate the deck so as to position the electronic device substantially out of the way for travel or when not in use, (ii) a first extended position in which the lower end of the lower mast section is substantially below the deck and the upper mast section is extended upwardly relative to the lower mast section to position the electronic device at a first elevated position above the deck, and (iii) a second extended position in which the lower end of the lower mast section is raised to be substantially proximate the deck and the upper mast section is extended relative to the lower mast section to position the electronic device at a second elevated position above the deck higher than the first elevated position, the second extended position being a height above the boat deck sufficient to enable a user to view and operate the electronic device while standing.

The base may include a trigger-lock which engages the lower mast section to maintain the lower mast section substantially proximate the deck when the telescopic mast is in the second extended position.

The base may also include a locking collar mounted to the lower mast section and includes a projection selectively engageable with the upper mast section so as to inhibit extension of the upper mast section when the projection of the locking collar is engaged with the upper mast section and allowing extension of the upper mast section when the projection is disengaged from the upper mast section.

In another aspect, the disclosure provides a well on a nose section of a boat within which a pedestal according to the disclosure may be installed. The well offers additional advantages and provides an aesthetically pleasing appearance.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

With reference to the drawings, there is shown a telescopic electronics pedestal 10 configured for installation onto a deck D of a boat B. The pedestal 10 is particularly configured for use with fishing electronics, such as an electronic fish-finder F. The pedestal 10 advantageously elevates the electronic fish-finder F to a convenient height above the deck level and gives the fisherman the ability to view and operate the device while fishing in a standing position, yet lower it so as conveniently position the fish-finder F to be out of the way for travel or when not in use.

Figure 1:
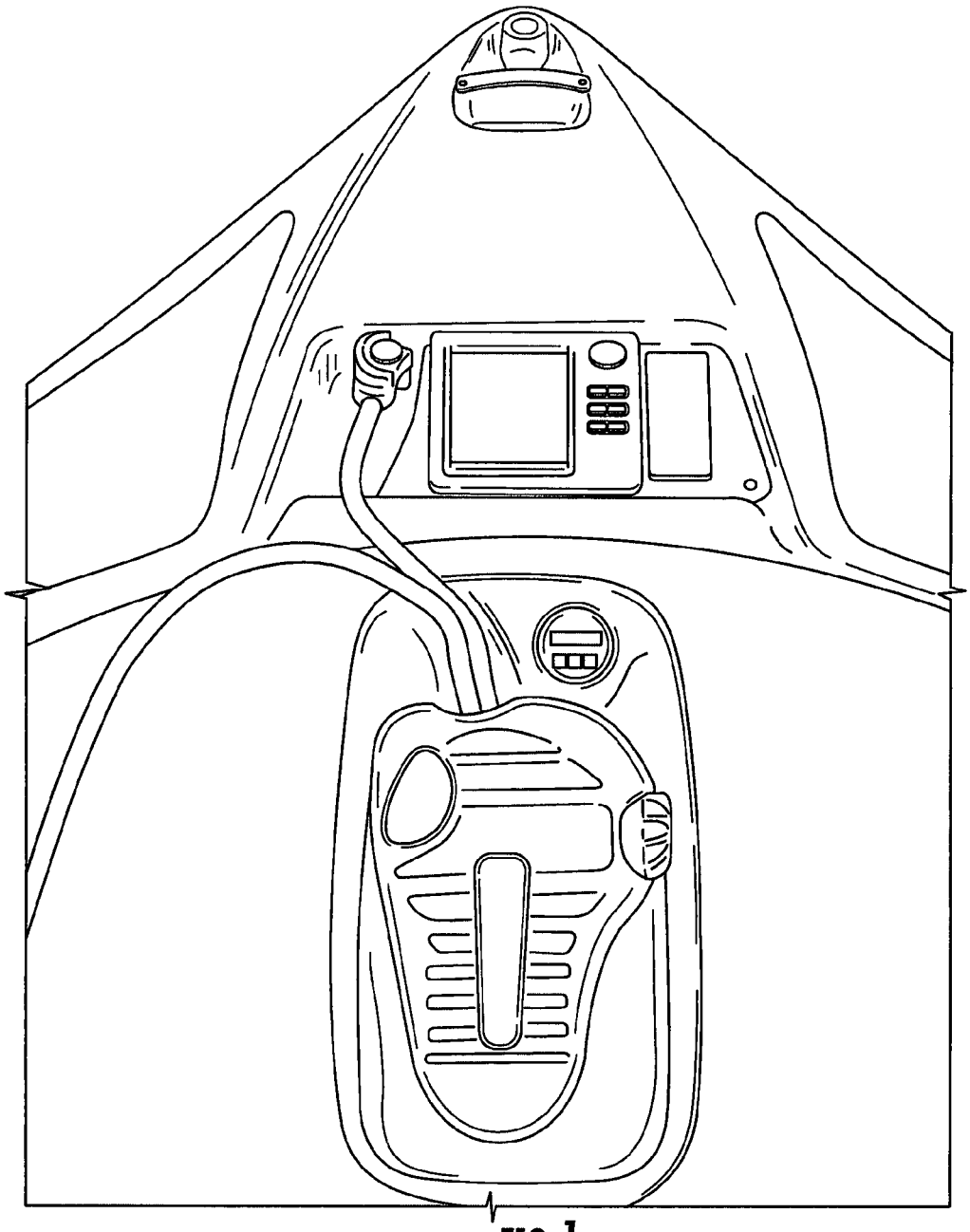
FIG. 1 PRIOR ART
FIG. 1 shows a prior art mounting of a fish-finder.
Figure 2:
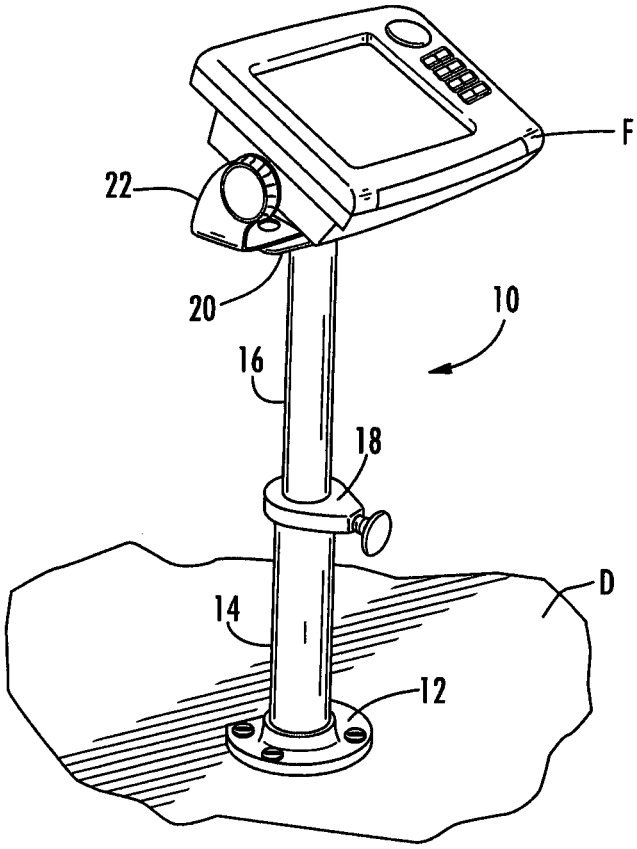
FIGS. 2 and 3 are perspective views of an electronics pedestal according to the disclosure.
Figure 3:
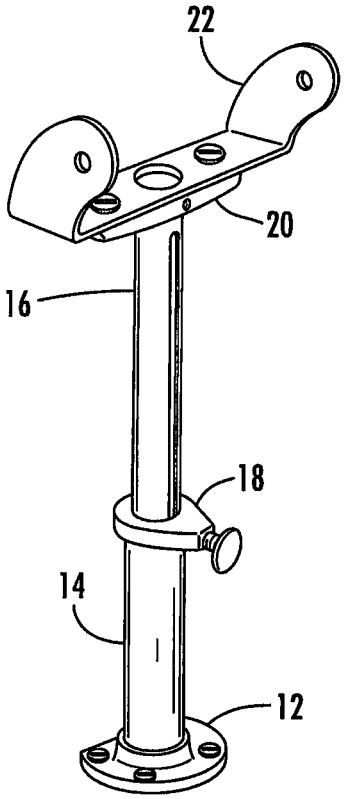

In FIGS. 2 and 3, the pedestal 10 is mounted onto the deck D. Additionally, as seen in FIGS. 10-17, the boat B may be configured to have a well W in a bow or nose section N of the boat B into which the pedestal 10 is installed. The pedestal 10 and the well W cooperate and the pedestal 10 may be fully retracted into the well W so that the fish-finder F is completely flush in the well W of the nose section N. This is advantageous to provide superior aerodynamics and good visibility for safer high speed operation of the boat, as well as providing an aesthetically pleasing appearance.

The pedestal 10 provides the fisherman the ability to view and operate the electronic fish-finder F up-close in a more comfortable posture. In the elevated position, the pedestal 10 brings the fish-finder F to within easy reach of the fisherman allowing the device to be viewed and read more accurately as well as operated more effectively. This advantageously reduces kneeling and squatting by the fisherman, which may enhance the fisherman's stamina by reducing fatigue. It can also save time, which may enable the fisherman to make more efficient use of allotted time for catching fish.

The pedestal 10 includes a base 12, a lower mast section 14, an upper mast section 16, a locking collar 18, and a universal gimbal bracket collar 20. A gimbal bracket 22 is mountable to the gimbal bracket collar 20, and the fish finder F attached thereto.

The base 12 may be of molded plastic construction, such as polyvinyl chloride, and includes a central aperture 24 surrounded by a sidewall 26 connected to an outer flat flange 28. A nylon set screw 29 preferably threadably extends through the sidewall 26 for engaging the lower mast section 14. The base 12 also includes a built-in trigger-lock system 30 that holds the lower mast section 14 in position when it is fully extended.

Figure 5:
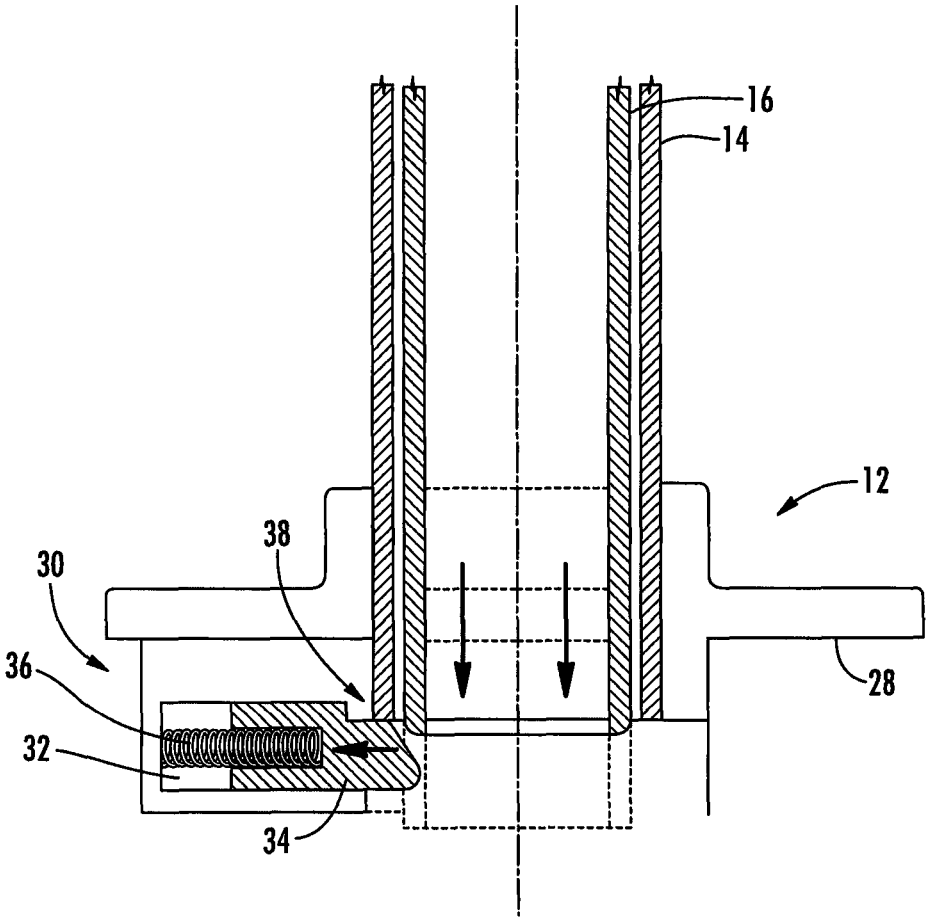
FIGS. 5 and 6 are cross-sectional side views of portions of the pedestal of FIGS. 2 and 3.

With reference to FIG. 5, the trigger lock system 30 includes a horizontal blind bore 32 located on a lower surface of the flange 28, with the bore 32 oriented so that its open end is adjacent and below the aperture 24 of the base 12. A lock 34 is slidably and yieldably disposed in the bore 32, with a spring 36 located between the lock 34 and the blind end of the bore 32. The lock 34 includes a distal end 38 configured to hold the lower mast section 14 in position when it is fully extended upwardly.

The base 12 may also preferably be of a metal, such as aluminum or the like. In the case of having the base 12 made of metal, it is preferred that the central aperture 24 be slightly larger (e.g., 0.25 inch) and include a split plastic sleeve (e.g., 0.125 inch thickness) that fits between the mast and the aperture 24, with the sleeve preferably being made of a plastic material such as NYLATRON available from DSM Plastics.

The mast sections 14 and 16 may be made of anodized extruded aluminum tubing. The lower mast section 14 preferably has a larger diameter than the upper mast section 16 so that the upper mast section 16 slides into the lower mast section 14, forming a telescopic mast.

The lower mast section 14 includes a longitudinal groove 40 along the exterior of the lower mast section 14, and a circumferential groove 42 at the uppermost end of the lower mast section 14.

The upper mast section 16 includes a longitudinal groove 50 along the exterior of the upper mast section 16, a circumferential groove 52 at the uppermost end of the upper mast section 16, and a lower circumferential groove 54 at the lowermost end of the upper mast section 16. The longitudinal groove 50 and the lower circumferential groove 54 intersect to define an aperture 56, and an aperture 58 is defined on the upper end of the longitudinal groove 50, each for cooperating with the locking collar 18, as described more fully below.

The locking collar 18 includes a central aperture 60 into which extends an internal spring-loaded plunge pin 62, preferably of stainless steel construction. The aperture 60 encircles the top mast section 16 and the pin 62 pops into the aperture 56 in the top mast section 16 to lock the top mast section 16 in position when it is fully extended. The pin 62 is manually retracted by use of a knob 64. Pulling the knob 64 on the side of the locking collar 18 releases the upper mast section 16 from the aperture 58, allowing it to be extended.

The universal gimbal bracket collar 20 may be of molded plastic construction, such as polyvinyl chloride, and is mounted at the top of the upper mast section 16 as by use of a pair of set screws for attaching the gimbal bracket 22. The gimbal bracket 22 is a custom-made aluminum gimbal bracket, designed to fit each specific brand and size fish-finder, mounts the unit to the top of the pedestal. Each custom bracket allows the electronic unit to tilt and be easily detached from the pedestal. The bracket 22 may be attached to the collar 20 as by use of a pair of machine screws, and the collar 20 may be attached with set-screws into a horizontal groove machined into the top of the upper mast section 16. The fish-finder F is installed to the gimbal bracket 22 using threaded knobs. All cables and wiring extend through the center of the pedestal 10 giving the system a neat appearance while concealing them and allowing the pedestal to move up and down freely.

The pedestal 10 may be mounted directly to the deck D, or the pedestal 10 can be mounted in the well W, (FIGS. 10-17). The fish-finder F when mounted on the pedestal 10 can be viewed and operated effectively from any of the three positions of the pedestal 10. In its lowest, fully retracted position (FIGS. 7, 10-12, and 15), when the pedestal 10 is directly mounted to the deck D (not in a well), the fish-finder F is approximately the same height above the deck as a standard gimbal bracket. In the fully retracted position, the mast of the pedestal 10 is totally out of sight, under the surface of the deck D.

The pedestal 10 can also be lifted to a choice of two elevated heights (FIGS. 8, 9, 13, 14, 16, and 17), making viewing and operating the fish-finder F much easier when the fisherman is either seated or standing. In either elevated position, the fish-finder F will tilt up and down, and selective operation of the pin 62 enables the fish-finder F swivel from side-to-side for viewing from different directions.

To raise the pedestal 10, the fisherman lifts straight-up on the fish-finder F itself. As the pedestal 10 reaches the limit of each section, it automatic locks into position. The trigger lock system 30 built into the under-side of the base 12, will automatically latch to hold the lower mast section 14 in position when it is fully extended. Pulling the knob 64 on the side of the locking collar 18 releases the upper mast section 16, allowing it to be extended.

To maintain forward alignment as the pedestal 10 is extended or retracted, the tip of the plunge-pin 62 runs in the vertical groove 50 of the upper mast section 16, and the nylon set-screw 29 extends into and runs in the groove 40 in the lower mast section 14. Anytime the fisherman needs to rotate the fish-finder F side to side, he can pull the knob 64 half-way out to release it from the aperture 56 or 58, which frees the upper mast section 16 to rotate relative to the lower mast section 14. The horizontal groove 54 in the upper mast section 16 will hold the pedestal 10 in the extended position while allowing the fish-finder F to turn from side to side. When the fish-finder F is returned back to a straight-forward direction, the pedestal 10 will automatically latch into position with the pin 62 engaging the aperture 56 or 58.

The fisherman may want to operate the fish-finder at the lower, "half-mast" or mid-position, especially while he is seated. This is done by lifting the fish-finder F only partially up, preventing the lower mast section 14 from reaching the top limit. The fisherman may pull the knob 64 to extend the upper mast section 16 only while holding the lower mast section 14 from reaching the top. When the upper mast section 16 is fully extended and locked into place, the fisherman may push the entire unit back down, leaving only the upper mast section 16 fully extended. If the lower mast section 14 unintentionally locks or is already locked, the fisherman may fully retract the upper mast section 16 until it triggers and releases the base 12, allowing the lower mast section 14 to drop slightly. Then, while holding the upper mast section 16 up, the fisherman may push the lower mast section 14 down until the upper mast section 16 locks.

Figure 4:
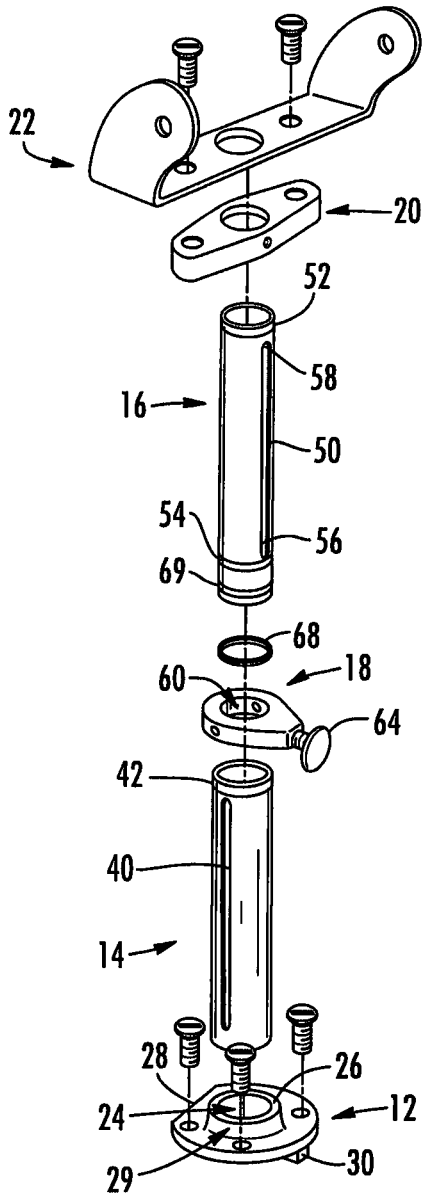
FIG. 4 is an exploded view of FIG. 3.
Figure 6:
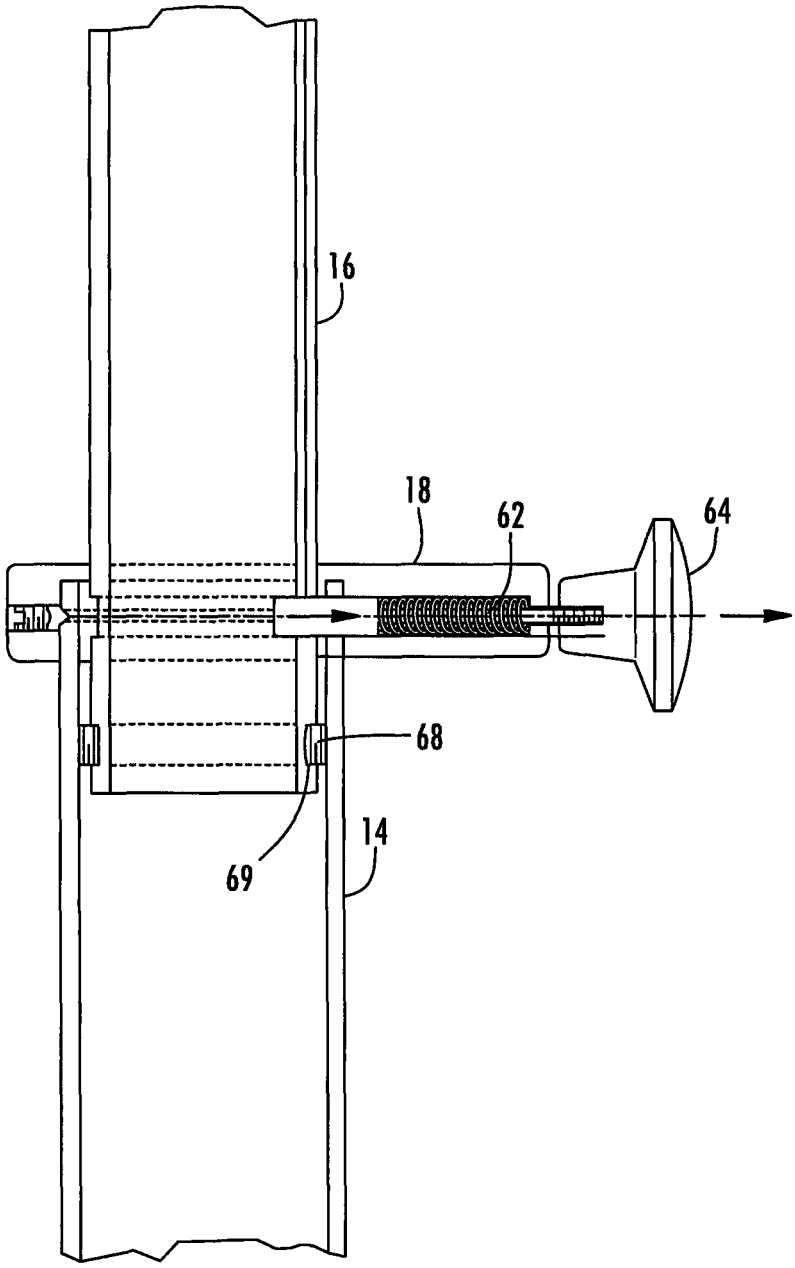
Figure 7:
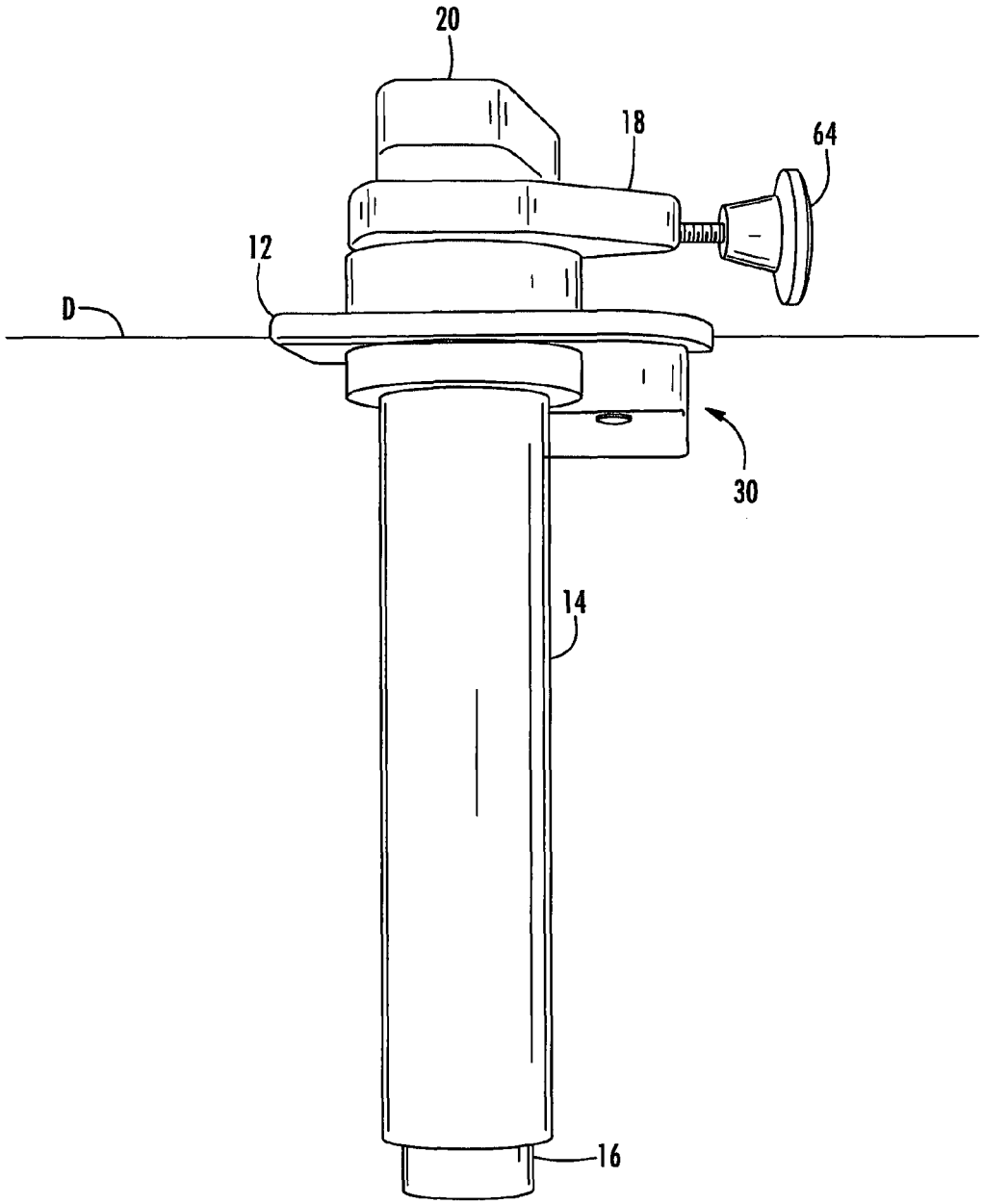
FIGS. 7-9 show telescoping of the pedestal of FIGS. 2 and 3.
Figure 8:
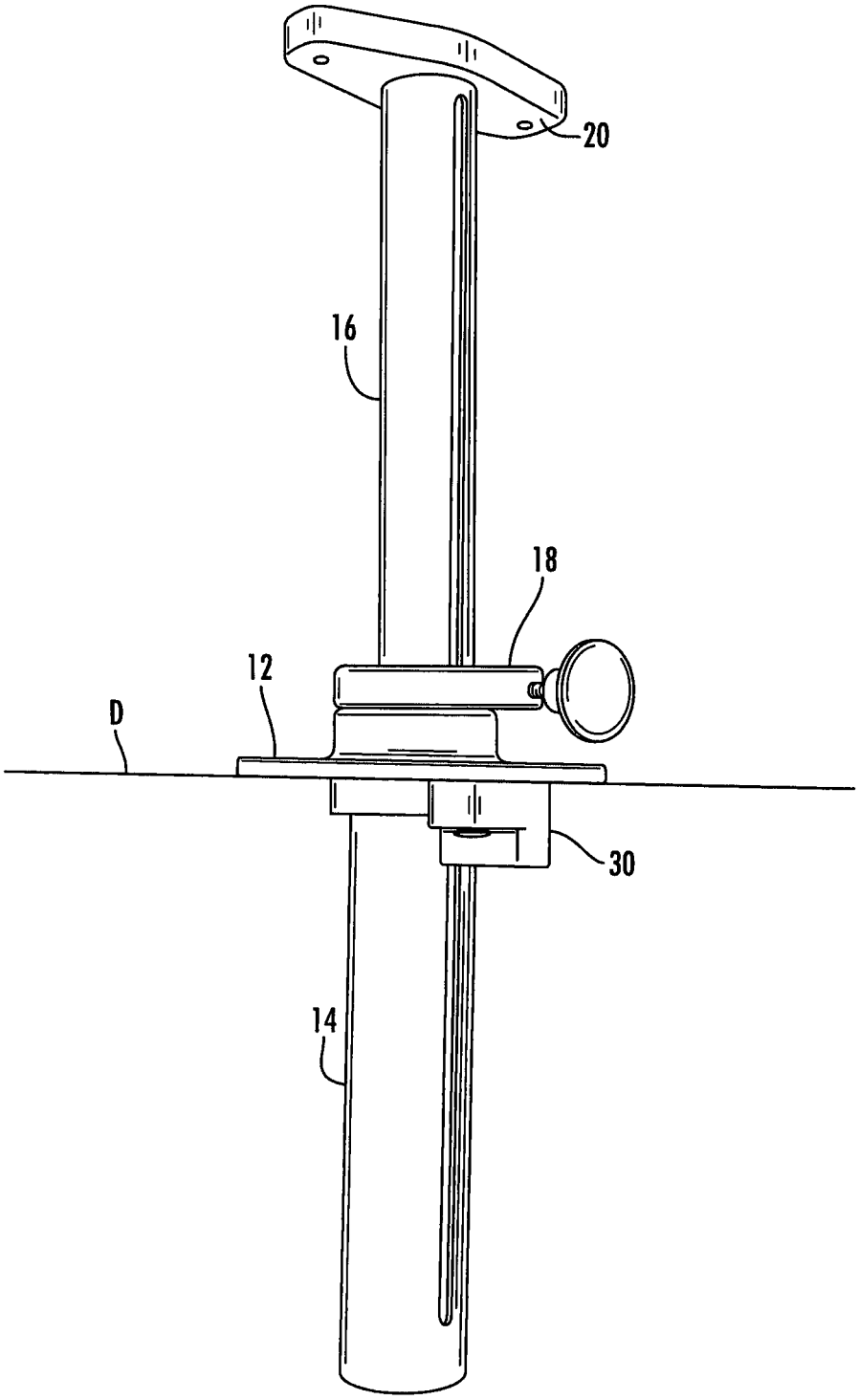
Figure 9:
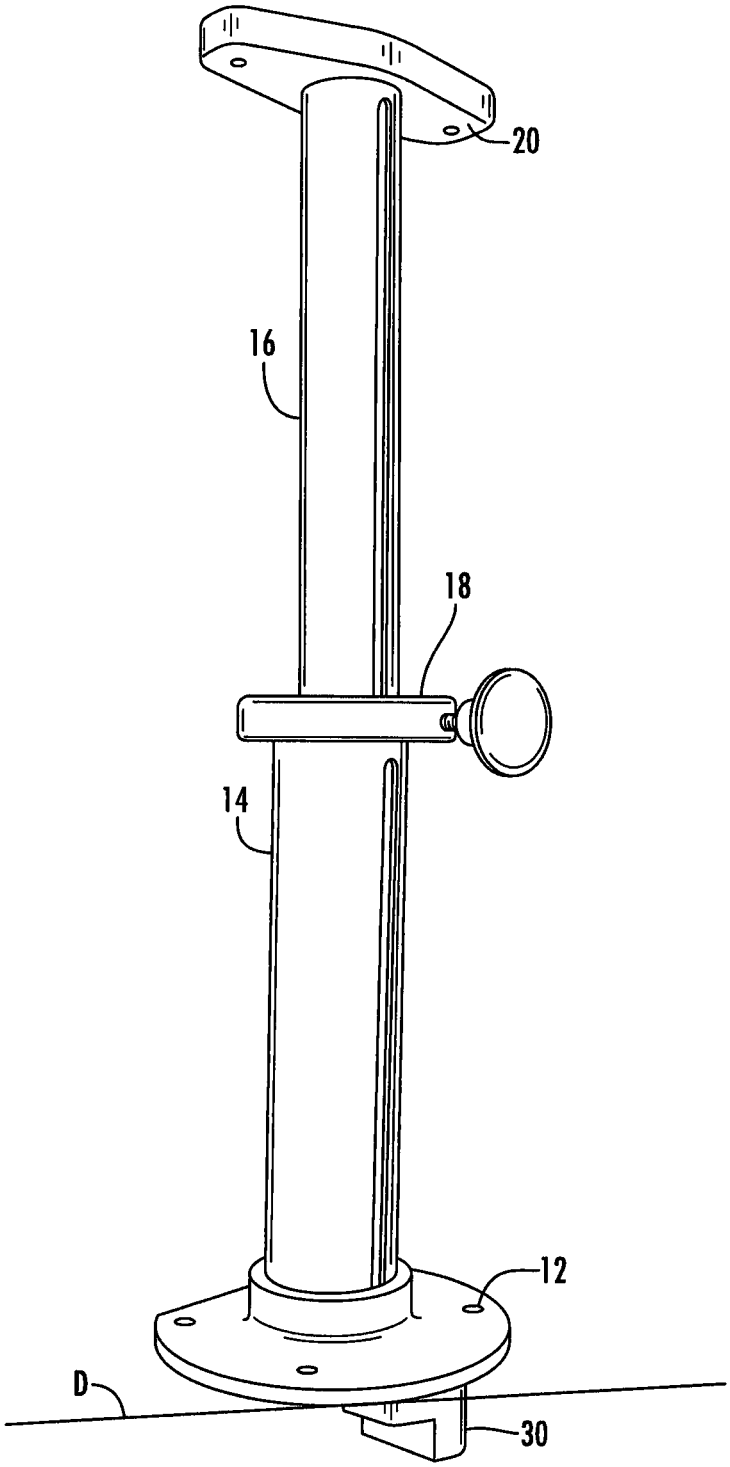
Figure 10:
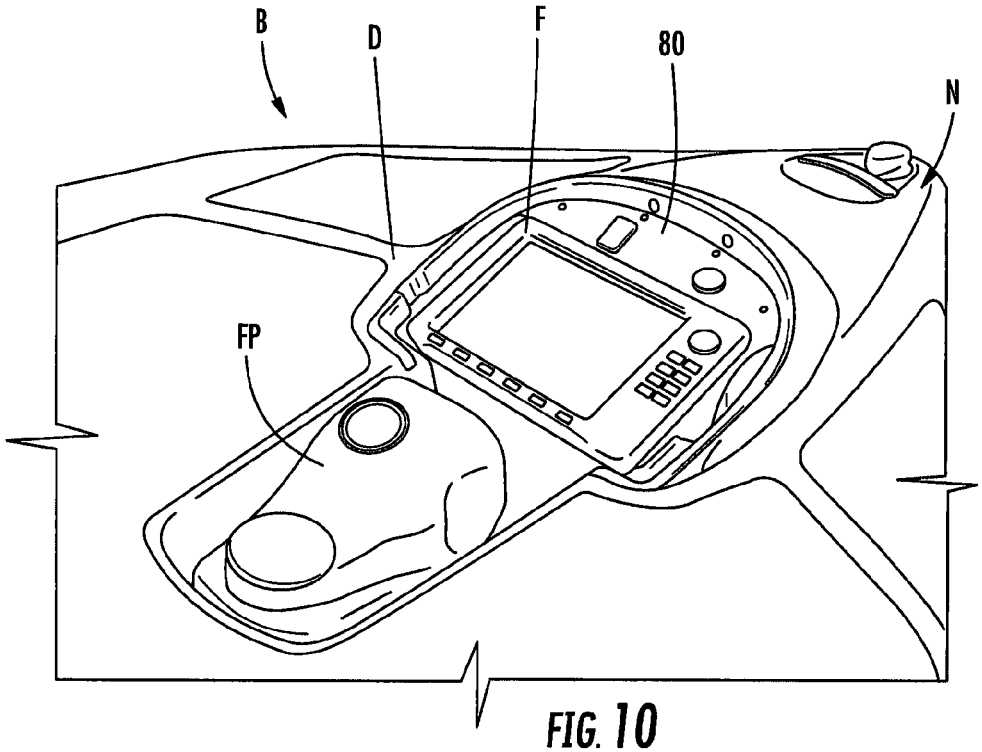
FIGS. 10-17 show the pedestal of FIGS. 2 and 3 installed within a well on a nose section of a boat according to another aspect of the disclosure.

Lowering of the pedestal 10, in either elevated position, is done by simply pulling the knob 64 and allowing the mast section to retract. The upper mast section 16 will release first and proceed to slide down into the lower mast section 14. Travel of the upper mast section 16 into the lower mast section 14 may be guided as by use of a nylon split-ring 68 (FIGS. 4 and 6) placed around the upper mast section 16 in the annular space between the two mast sections. If desired, an additional circumferential groove 69 may be provided on a lower portion of the upper mast section 16 to receive the split-ring 68. As soon as the upper mast section 16 reaches the bottom, it automatically releases the trigger-lock system 30 in the base 12, thus releasing the lower mast section 14 allowing it to retract through the base 12 and completely out of sight under the deck D.

The materials for the pedestal 10 are chosen for appearance and durability. There are other non-corrosive and compatible materials that could also be used in its construction. It will be understood that the pedestal 10 can also be fitted with various lift systems, including pneumatic lift cylinders, springs, and electric lift devices. It will be understood that the pedestal having other lift systems may require other types of locking mechanisms, but in the case of an electric lifting device, no lock system would be necessary.

Figure 11:
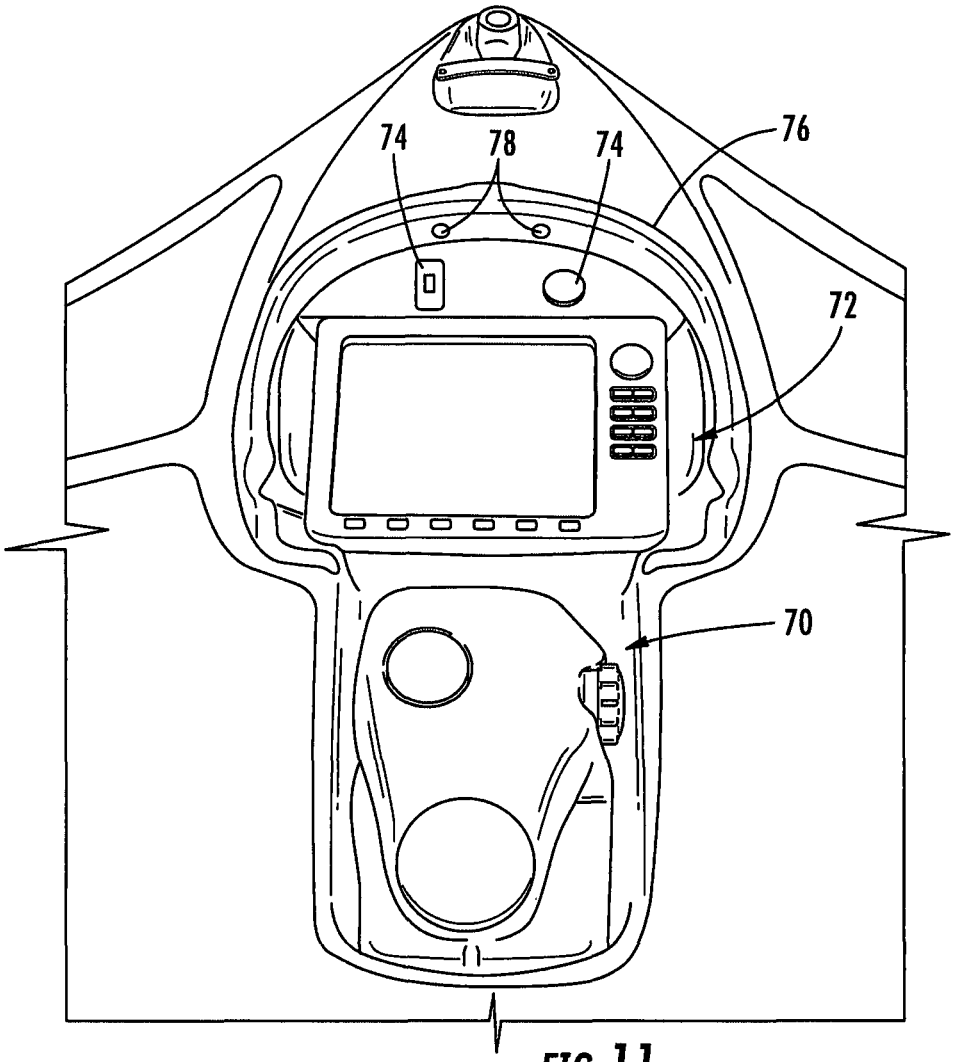
Figure 12:
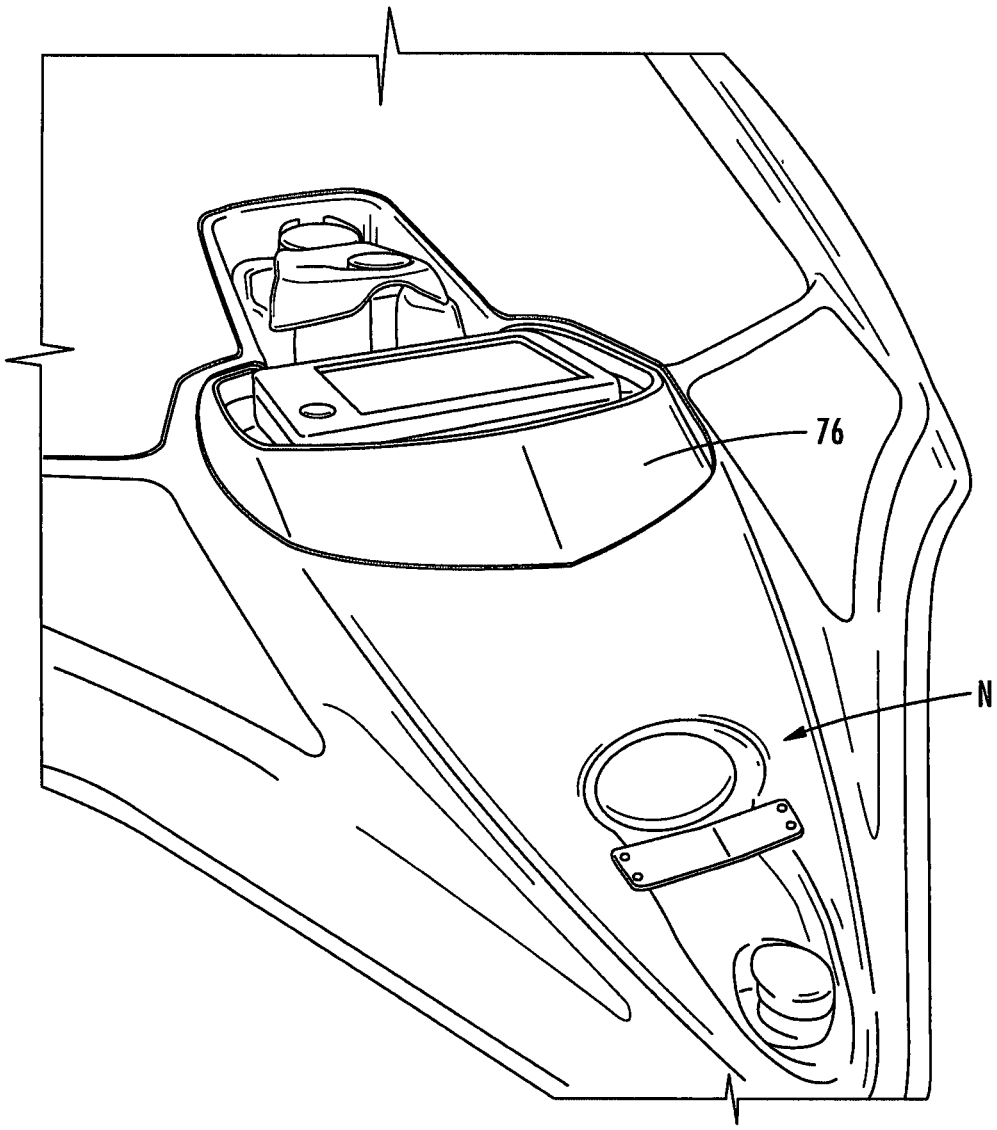
Figure 13:
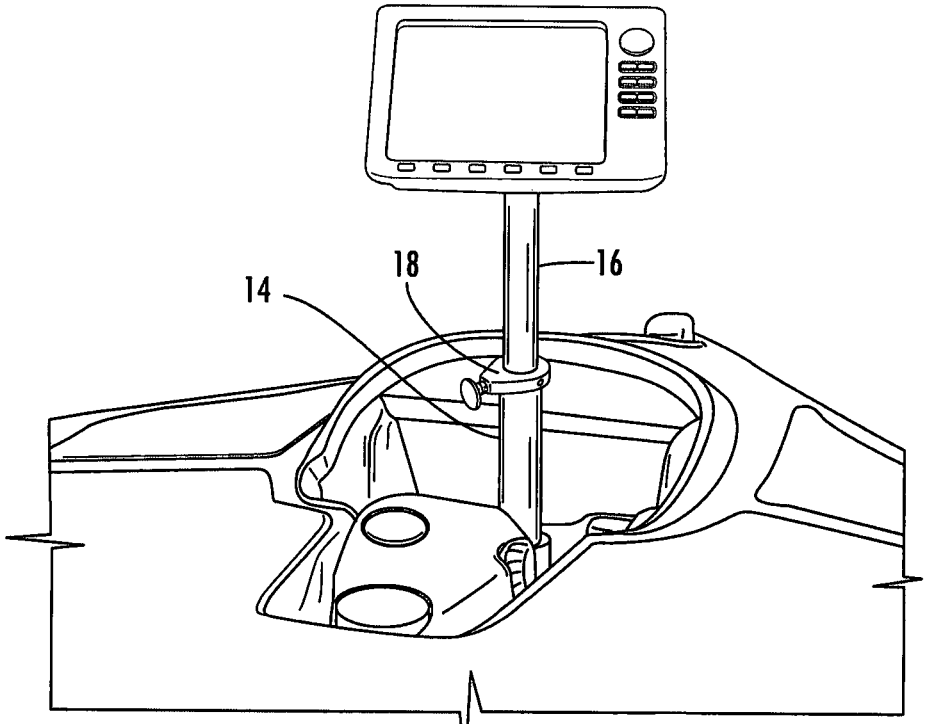
Figure 14:
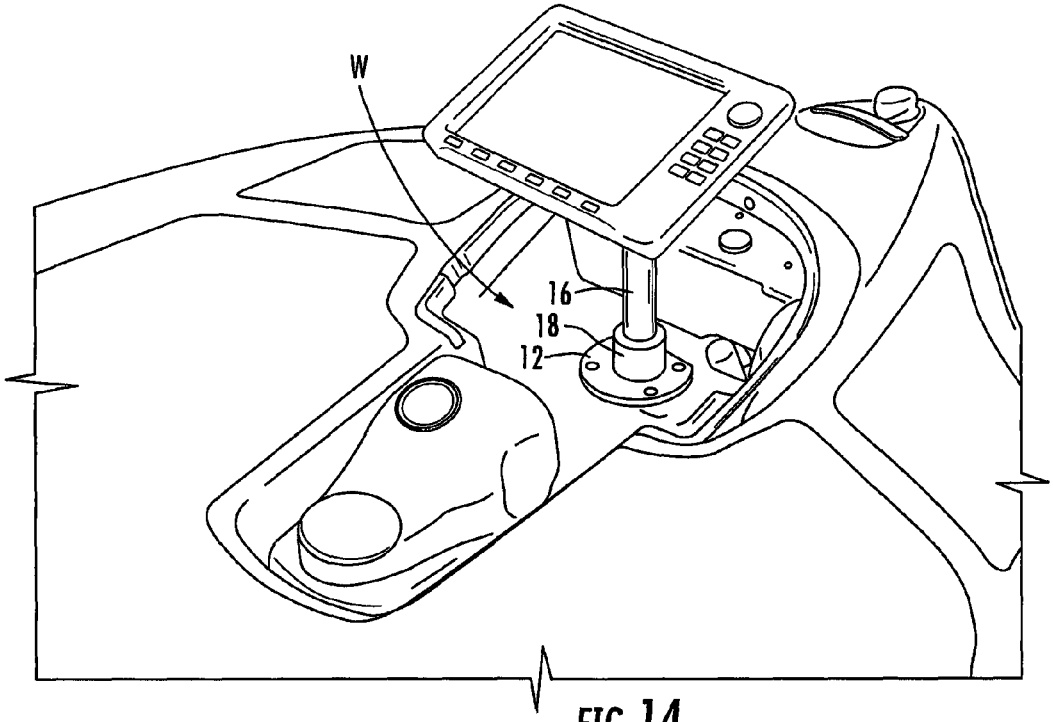
Figure 15:
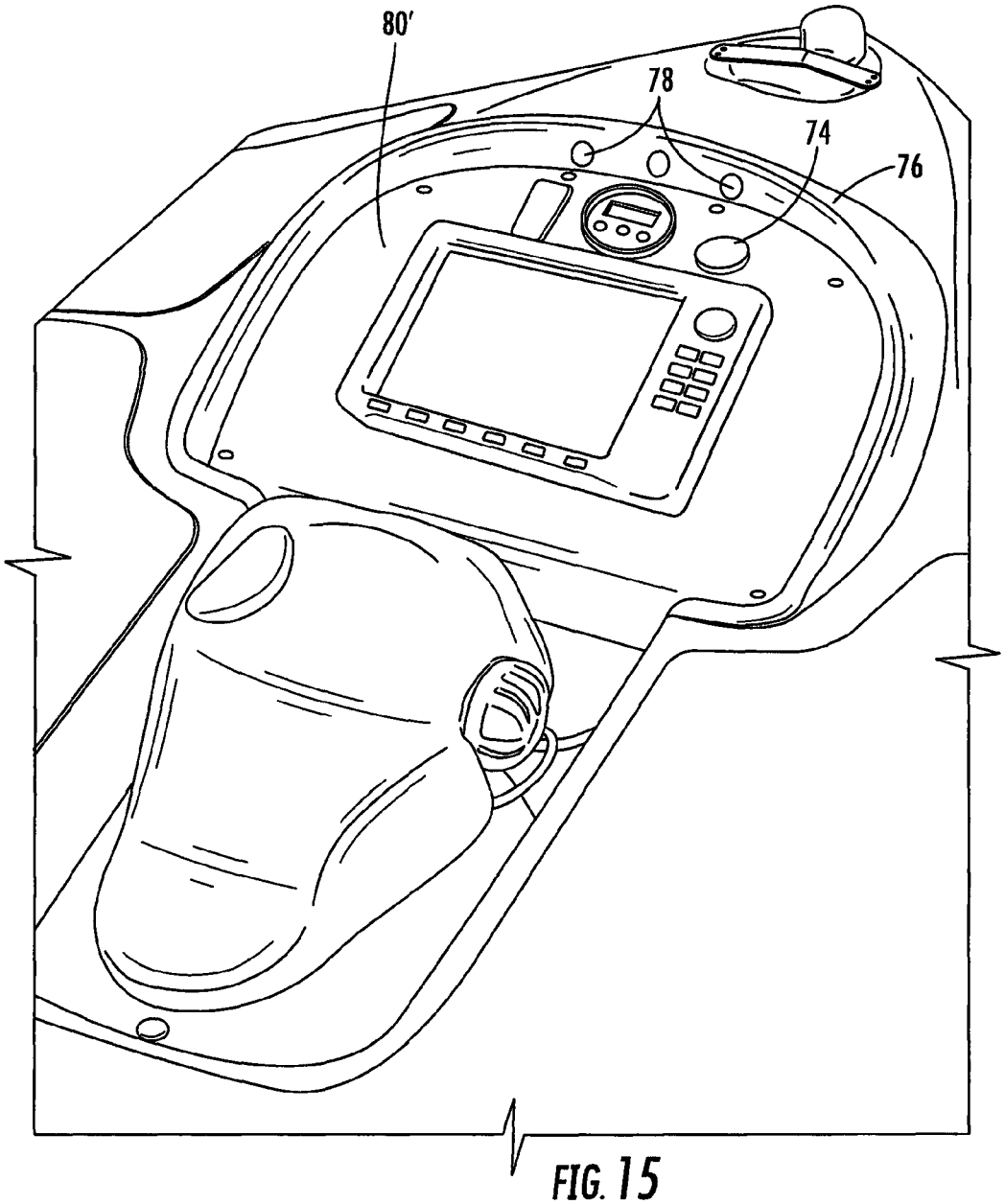

In this regard, it will be further appreciated that the well W provides an aesthetically pleasing appearance. The well W may be advantageously configured to include a rear portion 70 configured to accommodate a foot pedal FP of a trolling motor and a forward portion 72 configured for receiving the pedestal 10 having the fish-finder F mounted thereon. The pedestal 10 may be utilized with various sized fish-finders F, thus, the forward portion 72 of the well W is desirably dimensioned so as to accommodate the largest desired fish-finder F. For purpose of example, FIG. 11 shows use of a large fish-finder and FIG. 15 shows use of a smaller size fish-finder. The open space between the exterior of the fish-finder F and the borders of the forward portion 72 may be closed as by insertion of a cover plate 80 configured to cover just a forward portion of the well W (FIGS. 10-14) or a cover plate 80' to fully cover the open areas immediate the fish finder F (FIGS. 15-17).

Figure 16:
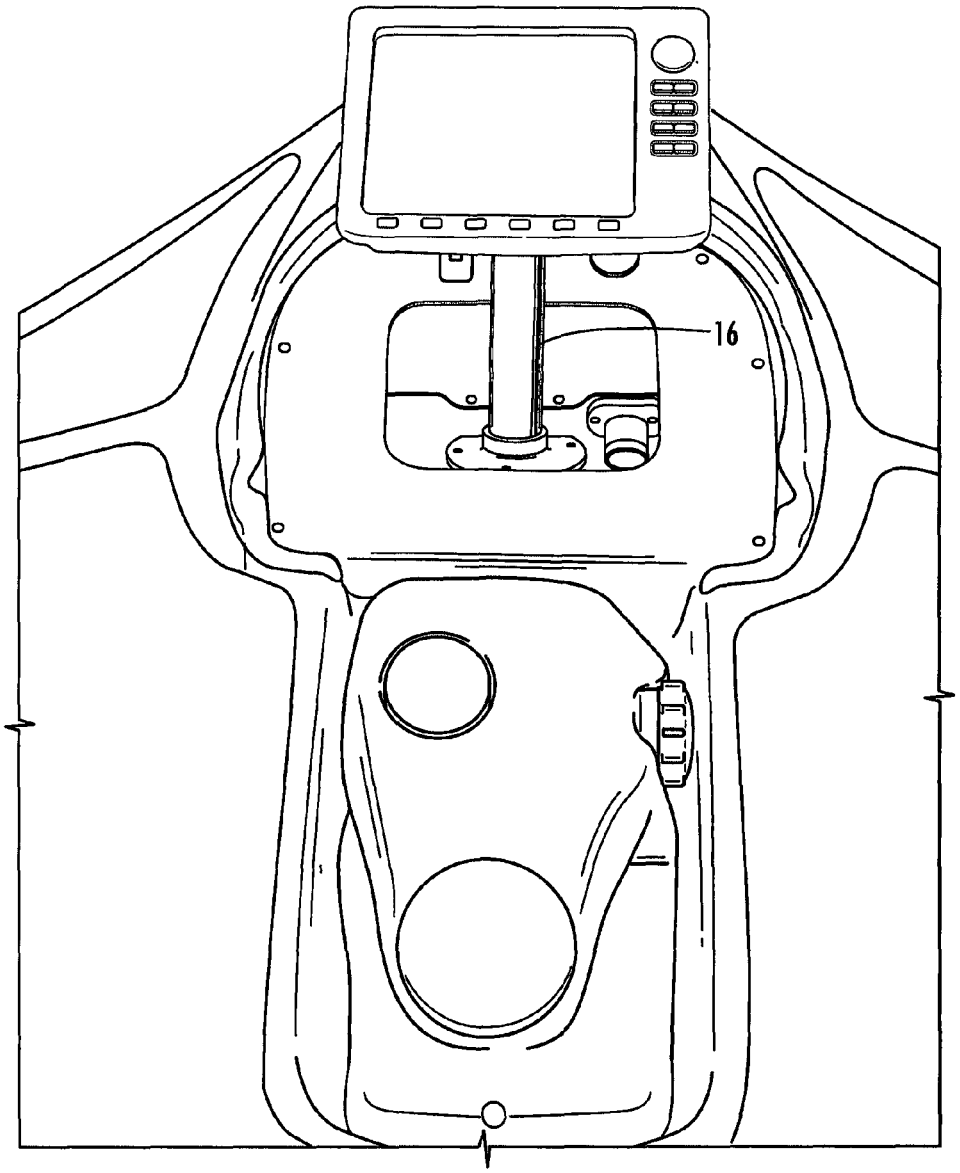
Figure 17:
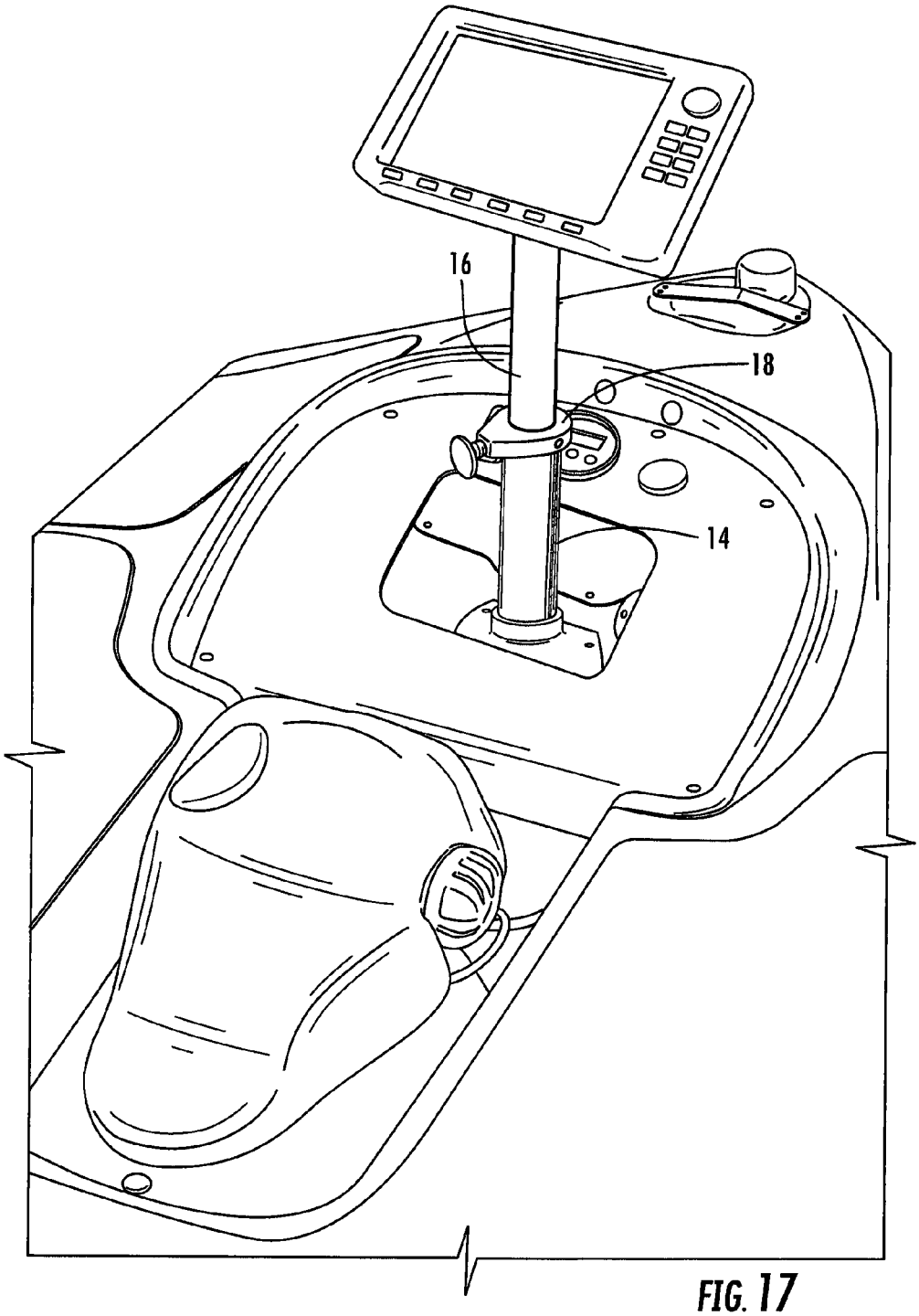

The cover plate 80' of the type seen in FIGS. 15-17 may be provided as a template for a given fish-finder brand so that the cover plate is cut to fit the utilized model and size of the fish-finder F and provide an aesthetically pleasing bow panel. The well W may include various outlets, receptacles, or ports, generally indicated by reference numeral 74. These may be, for example, ports for wires, cables, and the trolling motor, 12 volt receptacles, or the like, which ports, outlets, receptacles, associated gauges, and the like may be located on the cover plate 80 or 80'. Further aesthetics and function may be provided as by inclusion of a fairing 76 around the forward portion 72. The fairing 76 may also desirably include lights, such as light emitting diodes 78 located around the inner periphery of the fairing 76.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A boat, comprising:

a boat having a boat deck;

a pedestal mounted to extend vertically upward from the boat deck, the pedestal being configured to receive an electronic device and operative to selectively elevate the electronic device to a height above the boat deck sufficient to enable a user to view and operate the electronic device in a standing position, yet enable the electronic device to be lowered so as conveniently position the electronic device at a sufficiently low position so as to be out of the way for travel or when not in use, the pedestal comprising:

a base mounted to the deck adjacent an aperture defined through the deck, the base including a trigger-lock, a lower mast section slidingly positionable relative to the base and the aperture of the deck, an upper mast section, wherein the lower mast section has a larger diameter than the upper mast section so that the upper mast section slides into the lower mast section to form a telescopic mast that may be configured to:

(i) a retracted position in which a lower end of the lower mast section is substantially below the deck and the upper mast section is substantially within the lower mast section to position the electronic device substantially proximate the deck so as to position the electronic device substantially out of the way for travel or when not in use, (ii) a first extended position in which the lower end of the lower mast section is substantially below the deck and the upper mast section is extended upwardly relative to the lower mast section to position the electronic device at a first elevated position above the deck, and (iii) a second extended position in which the lower end of the lower mast section is raised to be substantially proximate the deck and the upper mast section is extended relative to the lower mast section to position the electronic device at a second elevated position above the deck higher than the first elevated position, the second extended position being a height above the boat deck sufficient to enable a user to view and operate the electronic device in a standing position;

wherein the trigger lock engages the lower mast section to maintain the lower mast section substantially proximate the deck when the telescopic mast is in the second extended position; and a locking collar mounted to the lower mast section and having a projection selectively engageable with the upper mast section so as to inhibit extension of the upper mast section when the projection of the locking collar is engaged with the upper mast section and allowing extension of the upper mast section when the projection is disengaged from the upper mast section.

2. The boat of claim 1, further comprising a well defined on the deck and into which the pedestal is mounted, wherein when the telescopic mast is in the retracted position, the electronic device is positioned to be substantially flush in the well.

3. The boat of claim 2, wherein the well includes a rear portion configured to accommodate a foot pedal of a trolling motor and a forward portion configured for receiving the pedestal having the electronic device mounted thereon.

4. The boat of claim 1, wherein the electronic device comprises a fish-finder.

5. The boat of claim 2, further comprising a cover plate configured to receive the electronic device and cover portions of the well that are otherwise open surrounding the electronic device.

6. The boat of claim 1, wherein the trigger lock includes a horizontal blind bore located on a lower surface of the base, with a lock slidably and yieldably disposed in the bore, with a spring located between the lock and the blind end of the bore.

7. The boat of claim 1, wherein the lower mast section includes a longitudinal groove along an exterior of the lower mast section, and a circumferential groove at the uppermost end of the lower mast section.

8. The boat of claim 1, wherein the upper mast section includes a longitudinal groove along an exterior of the upper mast section, a circumferential groove at an uppermost end of the upper mast section, and a lower circumferential groove at a lowermost end of the upper mast section, with the longitudinal groove and the lower circumferential groove intersect to define a first aperture, and a second aperture defined on the upper end of the longitudinal groove, each for cooperating with the locking collar for selective positioning of the upper mast section relative to the lower mast section.

* * * * *